US005752878A

United States Patent [19]

Balkany

[11] Patent Number: 5,752,878

[45] Date of Patent: May 19, 1998

[54] APPARATUS AND METHOD FOR TREATING AIR IN A BUILDING

[76] Inventor: Alexander Balkany, Morgentalstrasse 31, 8045 Zürich, Switzerland

[21] Appl. No.: 540,668

[22] Filed: Oct. 11, 1995

[30] Foreign Application Priority Data

Oct. 13, 1994 [CH] Switzerland ..... 3075/94

[51] Int. Cl.[6] ..... F24F 3/16

[52] U.S. Cl. ..... 484/236; 55/279; 422/24; 422/28; 422/123; 422/186.07; 422/186.3

[58] Field of Search ..... 55/279; 422/4, 422/22, 24, 28, 121, 123, 186.07, 186.3; 454/229, 233, 236

[56] References Cited

U.S. PATENT DOCUMENTS

| | | | |
|---|---|---|---|
| 2,150,263 | 3/1939 | Chesney | 422/121 X |
| 4,780,277 | 10/1988 | Tanaka et al. | 422/4 |
| 4,990,313 | 2/1991 | Pacosz | 422/121 |
| 5,160,481 | 11/1992 | Weaver | 422/186.07 |
| 5,368,816 | 11/1994 | Detzer | 422/28 |
| 5,601,787 | 2/1997 | Monagan | 422/121 X |

FOREIGN PATENT DOCUMENTS

| | | | |
|---|---|---|---|
| 0 282 301 | 9/1988 | European Pat. Off. . | |
| 0 390 159 | 10/1990 | European Pat. Off. . | |
| 0 431 648 | 6/1991 | European Pat. Off. . | |
| 0 567 775 | 3/1993 | European Pat. Off. . | |
| 3418511 | 11/1985 | Germany | 55/279 |
| 2-164703 | 6/1990 | Japan . | |
| 6-911137 | 4/1994 | Japan | 422/121 |
| 961260 | 6/1964 | United Kingdom | 55/279 |
| 1434851 | 5/1976 | United Kingdom | 55/279 |

OTHER PUBLICATIONS

*Heating, Piping & Air Conditioning*, Index for 1954 vol. 26, Nos. 1–12, Keeney Publishing Co., Chicago 2, Ill., Apr. 1954, pp. 82–87.

Ross, "Air conditioning a vaccine laboratory," *Heating, Piping/Air Conditioning*, May 1976, pp. 71–74.

*Patent Abstracts of Japan*, 03186319, Aug. 1991.

*Primary Examiner*—Harold Joyce

*Attorney, Agent, or Firm*—Marshall, O'Toole, Gerstein, Murray & Borun

[57] ABSTRACT

An air processing plant for a building transports air from rooms through first air ducts to a central and from there back to the rooms through second air ducts. Several consecutive ozone generators or ultraviolet light sources are arranged in the second air ducts. Ozone and nitrogen oxide catalyzers are arranged at the exits of the second air ducts. This arrangement allows to keep a large part of the duct system under ozone. In contrast to conventional plants, the maximum ozone concentration can therefore be lower while the formation of new germs is prevented.

15 Claims, 1 Drawing Sheet

APPARATUS AND METHOD FOR TREATING AIR IN A BUILDING

BACKGROUND OF THE INVENTION

1. Field of the Invention

The invention relates to a method and an apparatus for treating air in a building and especially for destroying germs and noxious substances in said air.

2. Description of the Prior Art

It is well known that the quality of air can be improved by treating it with ozone. Corresponding methods and devices are e.g. disclosed in the European patent applications EP 431 648 and EP 567 775. These documents describe heating or air conditioning plants, where the air passes through an ozone generator and a following ozone catalyzer arranged in a central station of the plant. The ozone generated therein acts on the air and removes germs and fungi as well as odorous and noxious substances. Thereafter, the ozone is decomposed in the catalyzer. The air treated in this way leaves the central station and is pumped through air ducts back into the rooms.

In practical operation it has been found that the air pumped from such stations back into the rooms often still contains a large number germs and noxious substances. Furthermore, the peak ozone concentrations required at the ozone generator are very high, which leads to undesired oxidation of components and to a high health risk in case of leakage.

SUMMARY OF THE INVENTION

Hence, it is a general object of the invention to provide an apparatus and a method for treating air that avoids these drawbacks.

Now, in order to implement these and still further objects of the invention, which will become more readily apparent as the description proceeds, the apparatus is manifested by the features that it comprises an arrangement of air ducts for guiding the air from rooms to a central station and from said central station to said rooms, and a plurality of disinfecting stations for disinfecting the air arranged at a distance from each other along at least part of said air ducts. A further aspect of the invention is manifested in a method for treating air in a building, comprising the steps of guiding the air from rooms through first air ducts into a central station, guiding the air from said central station through second air ducts back to said rooms, and maintaining germ destroying conditions in at least part of said first or second air ducts.

By providing a plurality of disinfecting stations arranged at a distance from each other, it becomes possible to keep a large part of the air ducts germ free while keeping the individual disinfecting stations small and simple.

Preferably, all air ducts leading from the central station to the rooms are kept under disinfecting conditions. In contrast to conventional plants it is thus avoided that the air can be contaminated in the ducts after passing through a single disinfecting device located at the central station.

In a first preferred embodiment ultraviolet light sources can be used as disinfecting devices. Such light sources emit a radiation that is lethal for germs. By positioning several such light sources one after the other, the individual sources can be of lower power, which reduces the price of the plant.

In a second preferred embodiment ozone generators are used as disinfecting devices. The arrangement of several ozone generators, one after the other, allows to keep large areas of the plant under an increased ozone concentration with only a low gradient, which avoids the necessity of high peak concentrations. This increases operational safety and reduces undesired oxidation.

Preferably, the ozone in the air is decomposed by means of ozone catalyzers positioned at the ducts leading from the central station to the rooms, i.e. at the exits of the ducts. Since the ozone concentrations are comparatively small, these catalyzers can be compact and cheap. No catalyzers are required between consecutive ozone generators.

In another embodiment of the invention an ozone gate with one or more ozone generators is combined with a device for decomposing nitrogen oxide, which is located close to the exit of the ducts. It has been found that the quality of the air can be improved by such a device, because most common ozone sources also generate nitrogen oxide.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
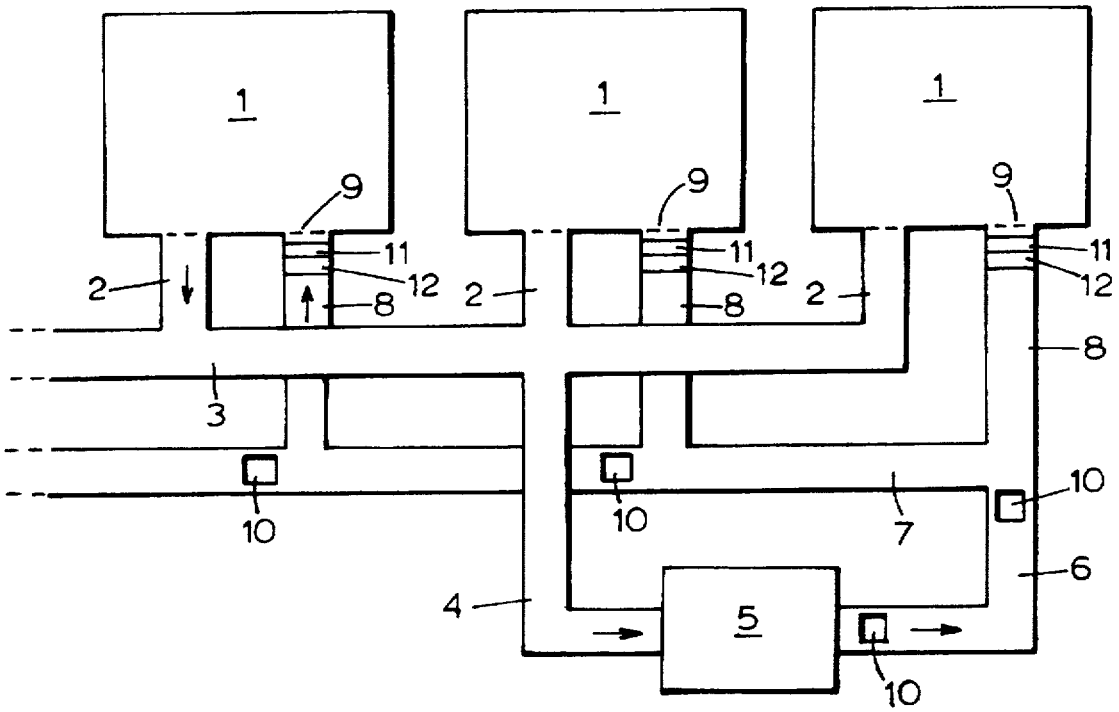
FIG. 1 a schematic diagram of a air processing plant according to the invention, FIG. 2 two consecutive ozone generators with regulating loops, and FIG. 3 the ozone concentration as a function of position in the air duct of FIG. 2.

FIG. 1 shows a simplified diagram of an air processing plant according to the present invention. This plant can be used for treating the air in a building and can e.g. be part of an air conditioning or heating system.

The building comprises several rooms 1. From each of these rooms 1, air is conducted through first ducts 2–4 to a central station 5. Central station 5 comprises a circulating pump, heating and cooling aggregates, mixing chambers for the addition of fresh air, devices for controlling the air's humidity, filters, etc. Such apparatus is known by a person skilled in the art and needs not be described here. From central station 5, the air is then brought back to the rooms 1 through second ducts 6–8 and air outlets 9.

In the present embodiment, several ozone generators 10 are arranged as disinfecting devices in the second air ducts 6 and 7. By means of these generators a ozone concentration sufficient for destroying germs and decomposing odorous and noxious substances is maintained in all second air ducts 6–8. Devices 11 for decomposing ozone are arranged close to or in the air outlets 9.

The ozone generators 10 can be devices of various design, which e.g. convert air oxygen into ozone. The devices 11 for decomposing ozone can also be of conventional design, such as ozone catalyzers as described in the European patent application EP 431 648. (As described below, the ozone generator can also be replaced by ultraviolet light sources.)

It has been found that many known ozone generators not only generate ozone but also nitrogen oxides. For preventing this nitrogen oxide from entering the rooms 1, devices 12 for reducing the nitrogen oxide contents in the air are provided at the air outlets 9. These can e.g. be suitable catalyzers or filters as they are known to a person skilled in the art.

The devices 11 and 12 can also be combined into one.

The installation of a device for reducing the nitrogen oxide concentration is also recommended for air processing plants that only use one single ozone generator, such as small air conditioning systems.

The devices 12 for reducing the nitrogen oxide concentration are preferably arranged before the ozone catalyzers because the performance of most known ozone catalyzers is affected by nitrogen oxide.

Figure 2:
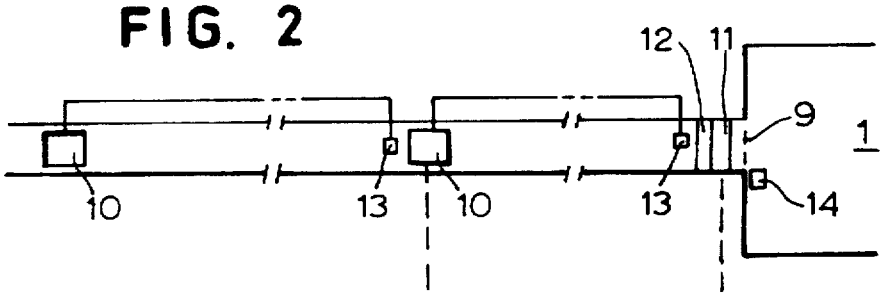

The operation of the ozone generators 10 is regulated. As shown in FIG. 2, each ozone generator 10 is provided with a ozone sensor 13. This sensor is arranged at the end of the section that is disinfected by its ozone generator, i.e. right in front of the next ozone generator 10 or the following catalyzer 11, 12. Regulating electronics in each ozone generator are provided for keeping the ozone concentration at sensor 13 on a predefined level. In this way, various degrees of pollution (which affect the rate of the ozone decomposition) are automatically compensated. If the air is strongly polluted, the ozone decomposition is increased, and, consequently, the generation rate is increased automatically for maintaining the predefined concentration at sensor 13.

Figure 3:
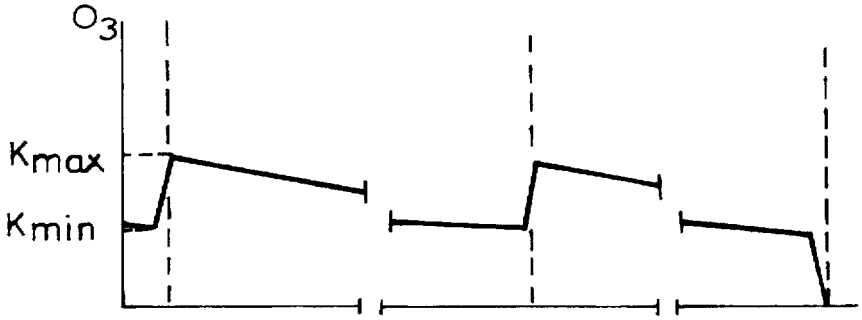

FIG. 3 shows the ozone concentration as a function of the position in the air duct of FIG. 2. After each ozone generator 10, the concentration reaches a maximum value Kmax and drops until the end of the following duct section to a minimum value Kmin. When ozone sensors 13 and regulating feedback loops as described above are used, Kmin corresponds approximately to the predefined ozone concentration.

This predefined or minimum ozone concentration Kmin should be chosen such that the effect of the ozone is sufficient for disinfection and suppressing the formation of new germs in the ducts. Its value depends on the conditions of operation and is influenced mainly by the time of passage of the air through the ozone containing sections, its temperature and humidity, and the concentration of oxidizeable substances.

The predefined or minimum ozone concentration can either be a fixed value or it can be controlled by a central controller as a function of the operating conditions, such as humidity, ventilation rate and temperature.

As mentioned above, the maximum value Kmax is preferably chosen in accordance to the signal from the detectors 13. It is large when consecutive ozone generators 10 or the last ozone generator and the following catalyzers 11, 12, respectively, are far apart. In the preferred embodiment, the spacing between ozone generators is preferably in the range of one or several ten meters, e.g. between 1 and 50 meter. To avoid excessive peak concentrations, it should be chosen such that the ratio Kmax:Kmin is clearly smaller than 10, even if the air is strongly polluted.

For monitoring the operation of the ozone catalyzer 11, a further ozone detector is arranged at outlet 9 (see FIG. 2). The value measured by this detector can be read from the room 1 and it indicates if the ozone concentration of the air entering the room exceeds a threshold value. For this purpose, a chemical indicator, such as wet potassium iodide, or an electronic detector having a display can be used. Such a threshold value monitor can also be used in conventional air processing plants with only a single ozone generator.

In the plant of FIG. 1, only the second air ducts 6–8 are held under ozone. For this purpose, the ozone generators 10 are arranged in ducts 6 and 7, a first of them immediately after central station 5. It is possible, however, to arrange a first ozone generator already in or before central station 5, as well as in the first air ducts 2–4, such that these sections can be disinfected, too, thereby increasing the efficiency of the plant and allowing a further decrease of peak ozone concentrations.

It is not necessary to operate the ozone generators continuously. They can also be operated in intervals.

As mentioned above, the ozone generators can be replaced by ultraviolet light sources as disinfecting devices. These light sources should preferably generate UV-C radiation. The effect of ultraviolet light on germs can either be direct (through radiative damage) or indirect (through the ozone generated by the UV-light).

While there are shown and described presently preferred embodiments of the invention, it is to be distinctly understood that the invention is not limited thereto but may be otherwise variously embodied and practiced within the scope of the following claims.

I claim:

1. An apparatus for treating air in a building comprising:

an arrangement of first air duct means for guiding the air from rooms to be treated to a central station, of second air duct means for guiding the air from the central station back to said rooms, of air outlets to said rooms; and a plurality of disinfecting stations arranged in series at predetermined distances along at least part of said air duct means such that said second air duct means are maintained under disinfecting conditions.

2. The apparatus of claim 1 wherein at least part of said disinfecting stations comprise an ultraviolet light source.

3. The apparatus of claim 1 wherein at least one of said disinfecting stations comprises an ozone generator.

4. The apparatus of claim 3 wherein said second air duct means comprises at least one ozone-decomposing device at said air outlet for decomposing ozone prior to entry into said rooms.

5. The apparatus of claim 4 wherein said ozone generators are arranged before said at least one ozone decomposing device.

6. The apparatus of claim 4 wherein a first of said ozone generators is arranged at or after said central station.

7. The apparatus of claim 3 wherein at least one of said ozone generators is provided with an ozone detector and means for regulating an ozone concentration, wherein said ozone detector of a first ozone generator is arranged immediately in front of a second following ozone generator.

8. The apparatus of claim 3 comprising at least one warning device in said rooms for displaying an excess ozone concentration in the air entering said room.

9. The apparatus of claim 1 wherein said second air duct means comprise at least one nitrogen oxide decomposing device at said air outlet for decomposing nitrogen oxide in said air prior to entry into said rooms.

10. A method for treating air in a building, comprising the steps of:

guiding the air from rooms through first air duct means into a central station, guiding the air from said central station through second air duct means and air outlets back to said rooms, and maintaining germ-destroying conditions in all of said second air duct means by a plurality of disinfecting stations arranged in series at predetermined distances.

11. The method of claim 10 wherein said germ-destroying conditions are maintained by means of ozone generators.

12. The method of claim 11 wherein said ozone concentration is reduced by an ozone-decomposing catalyzer or device at said air outlet before said air enters said rooms.

13. The method of claim 11 wherein said air is first led through at least two ozone generators before being led through an ozone-decomposing device.

14. The method of claim 13 wherein said ozone-decomposing device reduces said ozone concentration to a nonhazardous value.

15. The method of claim 11 wherein said air is led through a nitrogen oxide-decomposing device prior to entry into said rooms.

* * * * *